United States Patent [19]

Boiardi

[11] 4,326,817

[45] Apr. 27, 1982

[54] PAVING STONE AND WALKWAY FORMED THEREWITH

[76] Inventor: Mario J. Boiardi, Oneida Dr., Greenwich, Conn. 06830

[21] Appl. No.: 123,574

[22] Filed: Feb. 22, 1980

[51] Int. Cl.[3] ..... E01C 5/00; E01C 15/00

[52] U.S. Cl. ..... 404/41; 404/34; 404/39

[58] Field of Search ..... 404/41, 34, 37–39, 404/42, 46; 46/24, 25; 52/608; D25/93, 92

[56] References Cited

U.S. PATENT DOCUMENTS

| | | | |
|---|---|---|---|
| 115,457 | 5/1871 | Flanigan | 404/46 X |
| 449,739 | 4/1891 | Hazelton . | |
| 456,378 | 7/1891 | Hurlbut | 404/39 |
| 470,377 | 3/1892 | Graham . | |
| 1,045,328 | 11/1912 | Sammis | 404/41 |
| 1,961,677 | 6/1934 | Serra | 404/38 X |
| 3,903,702 | 9/1975 | Appleton | 404/41 |
| 3,905,172 | 9/1975 | Blackburn | 404/46 X |
| 3,931,700 | 1/1976 | Scanni et al. | 404/41 |
| 4,125,341 | 11/1978 | Reinschutz | 404/41 |

FOREIGN PATENT DOCUMENTS

| | | | |
|---|---|---|---|
| 515062 | 11/1952 | Belgium | 404/39 |
| 2440177 | 3/1976 | Fed. Rep. of Germany | 404/41 |
| 2500970 | 7/1976 | Fed. Rep. of Germany | 404/41 |
| 2707558 | 8/1978 | Fed. Rep. of Germany | 404/42 |

*Primary Examiner*—Rodney H. Bonck
*Attorney, Agent, or Firm*—Millard & Cox

[57] ABSTRACT

A plurality of pavings stones are organized in an array to form a walkway having the appearance of cobblestones. Each of the prime elements of the walkway includes an elongated stone having the general appearance of three hexagonal stones joined together. The sides allow the stones to be interfitted to with adjacent stones being offset one-half a hexagon or more. The top surface of the stones includes three rounded projections above the planar sidewalls so that earth, sand and the like which falls into the cracks between the projections will give the walkway the appearance of cobblestones.

2 Claims, 8 Drawing Figures

FIG. 1
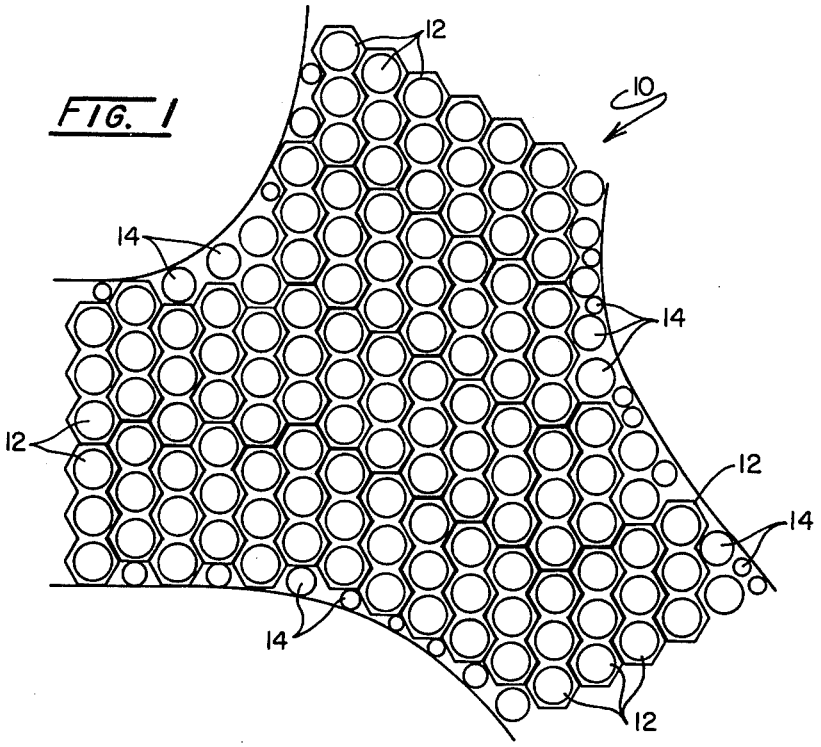
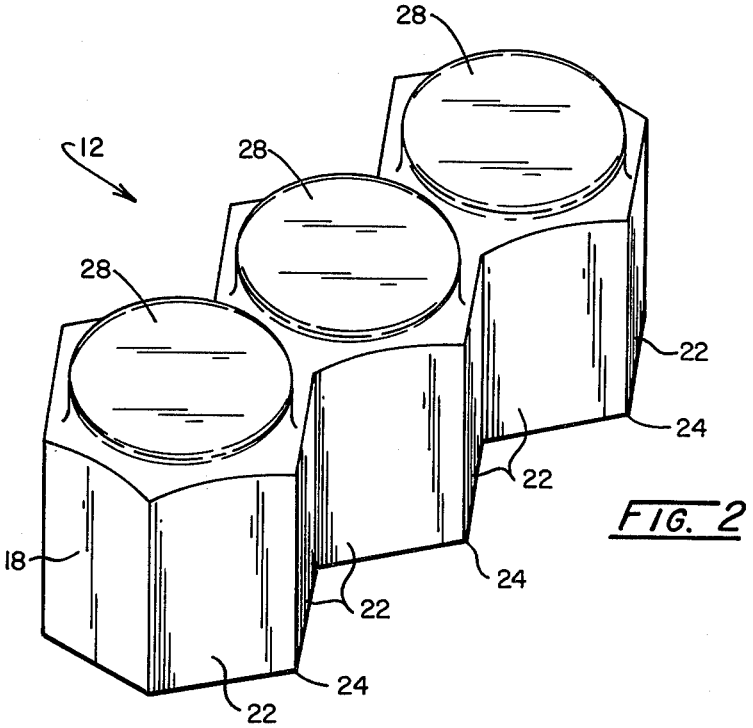
FIG. 2

PAVING STONE AND WALKWAY FORMED THEREWITH

BACKGROUND OF THE INVENTION

The construction industry has conceived of a number of artificial paving stones for use as a surface for streets and walkways and the intent is to provide a less expensive alternative to cobblestones which were used extensively in the last century. Individual stones ae considered to be esthetically superior to concrete slabs or asphalt; it is cetainly true that with differential settling, a concrete slab will crack and this could be unsightly.

Many of the original cobblestone streets still remain as built or they have been repaired extensively. Cobblestone streets and walkways have a certain artistic appeal and there are nostalgic feelings associated with them by many people. However, they are not the most easy surfaces to maintain nor are they the most comfortable to drive on or to walk on. Original cobblestones tend to be non-uniform in thickness and size and do not usually have a flat upper surface nor even a rounded one of suitable smoothness for ease of walking.

For the most part the construction industry has not tried to simulate cobblestones for the aforementioned reasons. The intent of most of the manufactured paving stones is to provide an interlocking mechanism of some sort to prevent lateral and/or vertical displacement of one stone relative to another and to provide a flat upper surface to the resulting street or walkway. The prior art is filled with hexagonal, undulating, interlocking, overlapping, bridging, "Z" and innumerable other shaped paving stones to provide decorative as well as stable structures. The idea of an imitation paving stone having an interlocking feature is not new, per se. However, I have invented an artificial paving stone which I believe to be unique and useful and it has a certain esthetical appeal, in that, it provides walkways or driving surfaces which give the appearance of being of cobblestones but the resulting walkway has a relatively flat upper bearing surface to minimize the rather bumpy surface of conventional cobblestones.

SUMMARY OF THE INVENTION

I have invented a paving stone designed to fit into an array wherein most of the stones in the array would be of the unique design to be described. Along the edges of the array may be a plurality of cylindrical paving stones of the same height and upper surface configuration as the unique paving stone to be described hereinafter. A plurality of different sizes of cylindrical stones along the edge are for the purpose of providing a smooth curve substantially completely filled in by the paving stones and without the jagged appearance which would result without the round stones.

The unique stone of this invention has a flat bottom and parallel planar ends. The sides consist of a series of planar surfaces joined together to form angles. Viewed from its top, the stone is symmetrical about an axis bisecting the two ends and it gives the appearance of three hexagons joined together to form one paving stone.

The upper surface of the paving stone includes three raised bearing surfaces which are essentially flat on the top but near their edges curve downward to merge in a smooth slope with the sides or adjacent projections, as the case may be.

Objects of the invention will be understood from the detailed description of the invention which follows.

BRIEF DESCRIPTION OF THE DRAWING

FIG. 1 is a plan view of an array of paving stones assembled in accordance with this invention;

FIG. 2 is a perspective view of the unique paving stone of this invention;

DESCRIPTION OF THE PREFERRED EMBODIMENT

Figure 3:
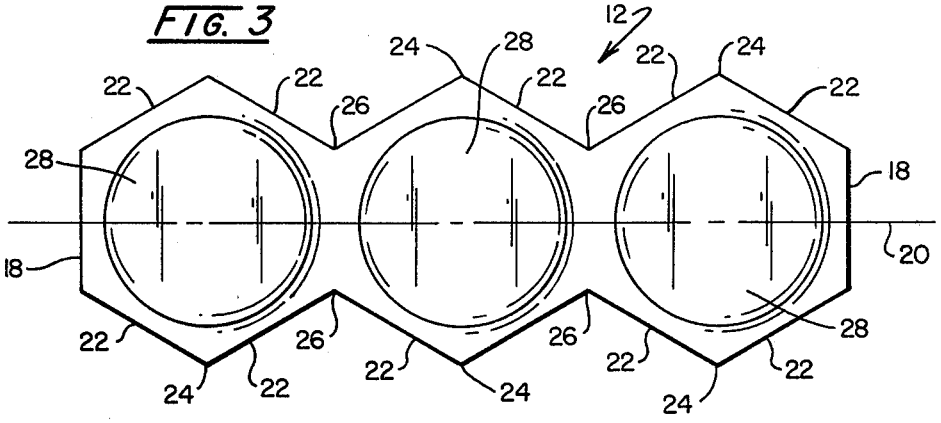
FIG. 3 is a plan view of the paving stone of FIG. 2.
Figure 4:
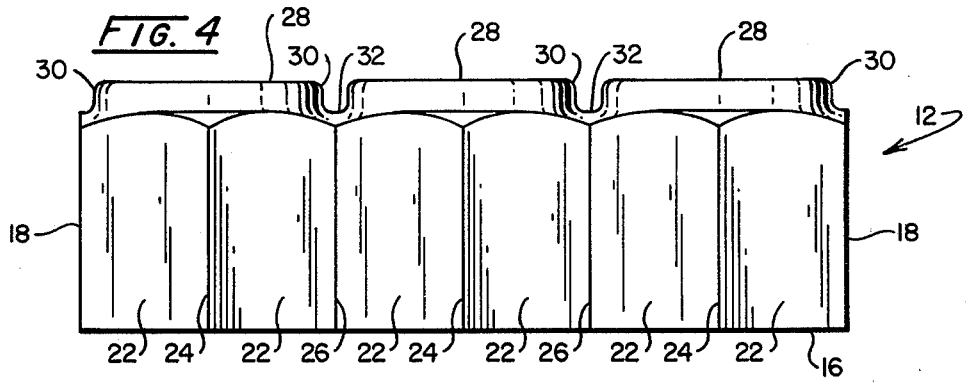
FIG. 4 is an side elevational view of the paving stone of FIG. 2.
Figure 5:
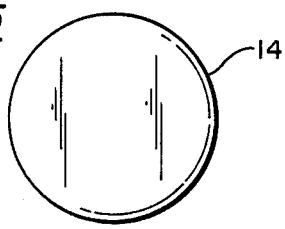
FIG. 5 is a plan view of a cylindrical paving stone according to this invention.
Figure 7:
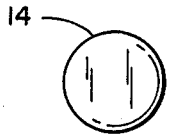
FIG. 7 is a plan view of a cylindrical paving stone according to this invention but smaller in diameter than the stone of FIG. 5.

Referring now to FIG. 1, a curved decorative walkway 10 is illustrated showing a plurality of polygonal paving stones 12 making up the large majority of the bearing surface. The polygonal paving stone is best seen in FIGS. 2–4. At the edges are cylindrical paving stones 14, best illustrated in FIGS. 5–8.

It will be observed that there are different sizes of cylindrical paving stones 14 at the edges of the walkway. The purpose of having a plurality of different sizes is to allow the cylindrical stones to fit in cavities not properly filled by the polygonal paving stones when they are assembled in proper order. It is clear that unfilled cavities are uniform in size where the walkway is linear. However, when the walkway curves, the edge cavities vary in size when the walkway edge is intended to be a smooth curve. Proper use of the cylindrical paving stones allows a workman to provide a relatively smooth curved edge without having to cut any of the polygonal stones 12. Labor has become such a proportionately large expense in the construction of roads and walkways that it has become necessary to provide labor saving devices in the form of predesigned elements to fill the gaps not inherently filled by the polygonal paving stones. The combination of stones provided allows curves or angles in a walkway without any stone cutting by the workmen.

Turning now to FIGS. 2 through 4, paving stone 12 has a flat or planar bottom 16 and two planar ends 18 which are parallel to each other. Observing FIG. 3, an axis 20 bisects the ends 18. The stone is symmetrical about axis 20 as viewed in the plan view of FIG. 3.

It will be observed that each side consists of a series of planar surfaces 22 joined together to form a total of five angles on each side, not including the angles formed with ends 18. Three angles 24, as measured on the exterior surface, are about 240° and two angles 26 are about 120°. The configuration of the series of planar surfaces 22 and the particular angles involved allows for a symmetrical structure wherein the paving stones can be laid side by side and internesting so that the point defined by angle 24 of one paving stone will be juxtaposed to the point defined by angle 26 on the adjacent paving stone. Thereby the paving stones will be offset by 1/6th the length of the adjacent paving stone (or greater if it is desirable to the workman and assists him in achieving the pattern desired). The interlocking mechanism of the side configuration as described prevents relative movement between adjacent paving stones and assures a relatively long life and uniform surface for many years.

It will be observed that the upper surface 28 of paving stone 12, which is the load bearing area, is raised slightly. That is, each bearing surface 28 projects upward from the top of paving stone 12 and has a generally circular and flat upper portion. However, near its edges at 30 it slopes or curves downward to merge smoothly with the adjacent side, end or adjacent projection 28. The resulting surface, once the stone is laid, will be relatively smooth for purposes of walking or riding, but it gives the esthetic appearance of a cobblestone surface. The asthetic affect is enhanced as the surface gets older because the traffic over the surface wil inherently result in the deposition of miscellaneous debris such as soil, sand, gravel, leaves, etc. which will eventually settle in the depressions 32 between the projections 28. Then the only exposed surface of the paving stones will be the upper projection 28. Thus the natural wear and tear on the walkway will make it appear even more like a cobblestone surface.

I have given consideration to dimensional factors in designing my unique paving stone, the weight factor in the ultimate stone to be deposited by workmen and in just how the paving stones will be laid. It is desired that the paving stones be molded from a cementitious mixture which may or may not have decorative marble chips or the like near the upper surface 28. The length of the paving stone 12 as measured along axis 20 is approximately 11¼" (28.54 cm). Each planar side surface 22 and end 18 has a width, as observed in FIG. 3, of approximately 2⅛" (5.38 cm). The height of the stone measured from the bottom 16 to the upper surface 28 is about 2⅜" (5.18 cm) and the height of the projection (or the depth of the groove 32) is about 3/16" (0.4 cm).

The widest part of the paving stone measured perpendicular to the axis 20 as for example between to points of angles 24 is about 4⅛" (10.46 cm).

Figure 6:
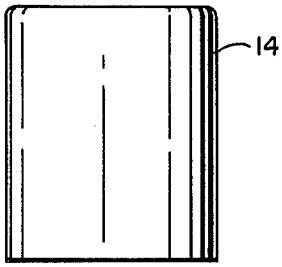
FIG. 6 is an elevational view of the cylindrical paving stone of FIG. 5.
Figure 8:
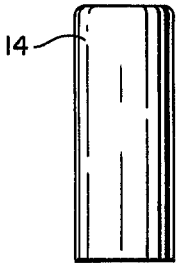
FIG. 8 is an elevational view of the cylindrical paving stone of FIG. 7.

Each of the cylindrical paving stones 14 as depicted in FIGS. 6 and 8 will have the same height as given for the paving stone 12.

It will be observed that the paving stone 12 is longer as measured along the axis 20 than it is wide as measured between the angles 24 located on a line perpendicular to the axis 20. It will also be observed that the width between angles 24 is greater than the height of the paving stone between the botton 16 and the top of projections 28. These are not idle or arbitrary relationships accidentally arrived at. Overall, the stone is intended to be short and wide. The dimensions, one relative to the other, minimize the likelihood of tipping or misaligning as a result of continued traffic and even in installation.

The weight of the resulting concrete paving stone 12 having the dimensions stated, will not be excessive nor fatiguing for ordinary workmen in the installation of a walkway as contemplated by this invention and it is anticipated that because of the dimensions, a relatively smooth curve can be constructed without use of excessive numbers of cylindrical paving stones 14. As with any road or walkway, a relatively smooth under surface, perhaps having a sand bed, will be necessary prior to the installation of the paving stones and, depending upon the depth to which the paving stone is set into the ground, it may be desirable to have a special edging of some kind to assist in maintaining the cylindrical paving stones 14 in proper place. However, this latter should not be necessary if the paving stones are deposited with their upper surface approximately flush with the existing ground level.

Having thus described the invention in its preferred embodiment it will become obvious to those having ordinary skill in the art that certain modifications may be made to the structure as described. It is not my intention to limit the invention by the specification nor the language used therein. Rather it is intended that the invention be limited only by the scope of the appended claims.

I claim:

1. An array of paving stones forming a curved walkway wherein the upper surface portion of each stone includes one or more projections with generally flat upper surfaces curving downwardly at the outer edge thereof; said projections being generally circular in plan view;

said stones including individual stones circular in cross-section disposed only near the edges of said walkway, the top surface of each individual stone including a single said projection which is generally circular and planar and which at its outer edge slopes downwardly toward the cylindrical side of the stone, additional paving stones comprising a majority of the surface area of the walkway with said additional paving stones being uniform in size and configuration, said additional paving stones having:

a. two sides and two ends, b. the ends being planar and parallel to each other, c. an axis bisecting the two ends, d. in plan view the stone being symmetrical about said axis, e. each side including six planar surfaces of equal area intersecting each other to form five angles as viewed in a plan view, the angles formed including three of about 240° and two of about 120° as measured on the exterior of the side, the additional stones including a planar bottom and a top having three elevated projections, the length of said stone as measured along its axis being greater than the width of said stone at its widest part as measured perpendicular to said axis, said width being greater than the height of the stone, the height being the distance perpendicular to the bottom and extending to the highest point on any projection, said individual stones serving to fill the gaps left between said additional stones and at least one smoothly-curved edge of said walkway.

2. The array of claim 1 wherein the spaces between the projections are partially filled with soil, sand and the like to provide the array with the appearance of a cobblestone walkway.

* * * * *